US006619244B1

(12) United States Patent
Ho

(10) Patent No.: US 6,619,244 B1
(45) Date of Patent: Sep. 16, 2003

(54) EXPANSIBLE CHAMBER ENGINE

(76) Inventor: Patrick C. Ho, 4 Quail Run, Hilton, NY (US) 14468

( * ) Notice: Subject to any disclaimer, the term of this patent is extended or adjusted under 35 U.S.C. 154(b) by 0 days.

(21) Appl. No.: 09/928,742

(22) Filed: Aug. 13, 2001

(51) Int. Cl.[7] ..... F02B 75/18
(52) U.S. Cl. ..... 123/56.1; 92/146; 123/53.6
(58) Field of Search ..... 123/56.1, 55.2, 123/58.1, 46 B, 53.6, 52.1, 52.2, 52.5; 92/146

(56) References Cited

U.S. PATENT DOCUMENTS 3,745,887 A * 7/1973 Striegl ..... 92/146
4,334,506 A * 6/1982 Albert ..... 123/51 B

* cited by examiner

*Primary Examiner*—Tony M. Argenbright
*Assistant Examiner*—Katrina B. Harris
(74) *Attorney, Agent, or Firm*—Eugene Stephens & Associates

(57) ABSTRACT

This engine 1 relies on a flywheel having a flywheel axis and an undulating cam surface. A piston with a roller at its base is positioned in a cylinder such that the roller abuts the undulating cam surface at some radial distance from the flywheel axis. Thus, as the piston is pushed downward by an explosion in the cylinder, it pushes against the cam surface causing the flywheel to rotate. As the flywheel continues to rotate its undulating surface pushes the piston back into position for a repetition of the cycle. More complex embodiments include one in which undulating surfaces are located on opposite faces of the same flywheel with separate pistons interacting with each face and one in which undulating surfaces are located on the facing surfaces of two separate flywheels with pistons positioned between the flywheels. In the latter embodiment, pistons can share the same cylinder.

18 Claims, 2 Drawing Sheets

EXPANSIBLE CHAMBER ENGINE

BACKGROUND OF THE INVENTION

This invention is a new form of expansible chamber engine. It is intended primarily as an internal combustion engine, and will be so described, but its characteristic features are applicable to use also with steam.

The prior art includes piston engines, rotary engines, and other well known engine types, but these are not sufficiently relevant to require discussion. I know of no specific prior art.

SUMMARY OF THE INVENTION

In summary, the engine of this invention includes a rotatable flywheel with an undulating cam surface, and an expansible chamber device including a piston abutting the cam surface and movable in a cycle between retracted and extended positions. The cycle includes a power stroke of the piston from its retracted position to its extended position to urge the piston against the cam surface to thereby rotate the flywheel, and a compression stroke from the extended position to the retracted position in response to the cam surface.

DETAILED DESCRIPTION

Figure 1:
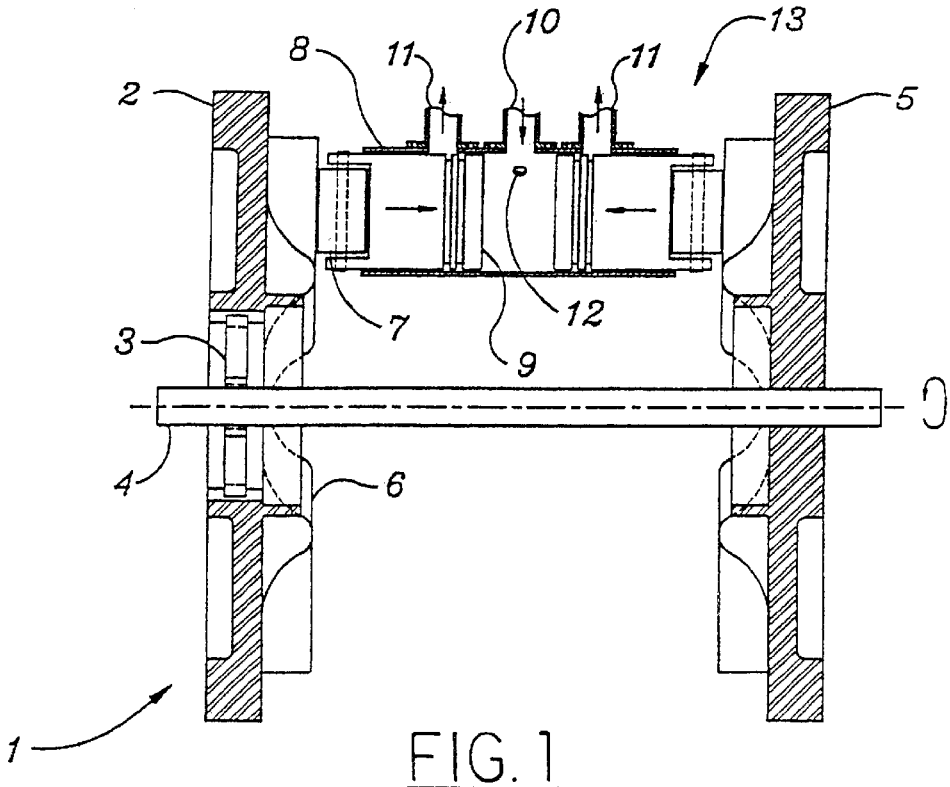
FIG. 1 is a side view, partly in section, of an engine according to this invention.

Referring to the drawing, my engine 1 includes left and right flywheels 2, 5 on an output shaft 4, and an expansible chamber device 13 between the flywheels, radially offset relative to the shaft 4.

Figure 2:
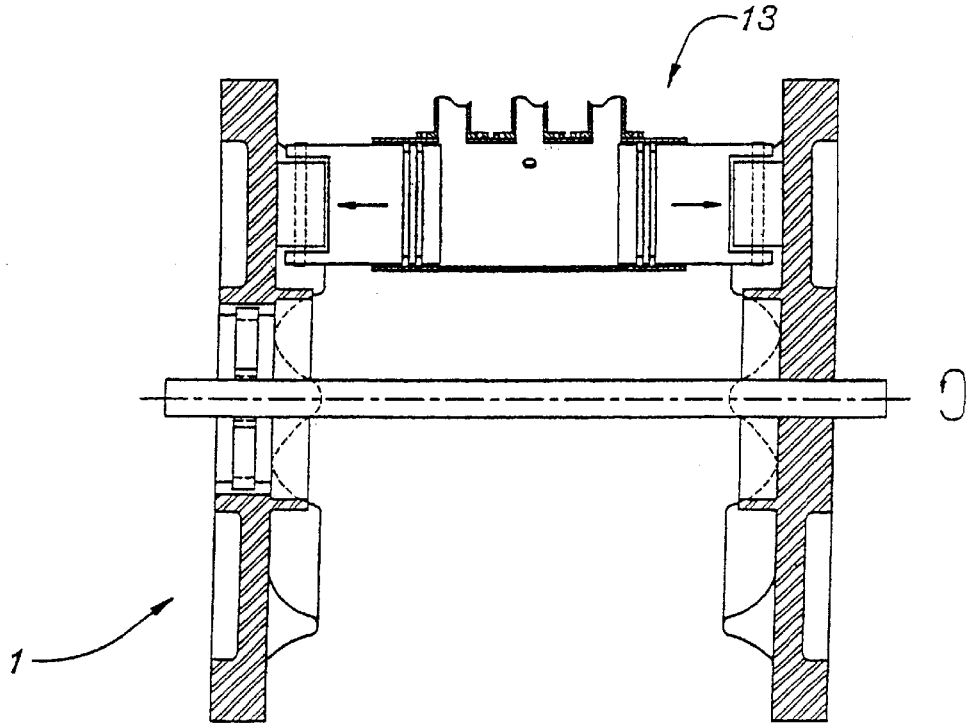
FIG. 2 is view similar to FIG. 1, showing engine pistons in different positions.

The expansible chamber device 13 includes a stationary cylinder 8 with left and right pistons 9 movable in the cylinder between retracted positions (FIG. 1) and extended positions (FIG. 2). The cylinder 8 includes an air inlet port 10, left and right exhaust ports 11, and a fuel inlet port 12. For gasoline application the port 12 is for both fuel injector and spark plug. For diesel application the port 12 is for fuel only. Each piston 9 includes a cam roller 7 on its outboard end. Details of the inlet and exhaust ports are not part of this invention, and are not shown in the drawing.

Figure 3:
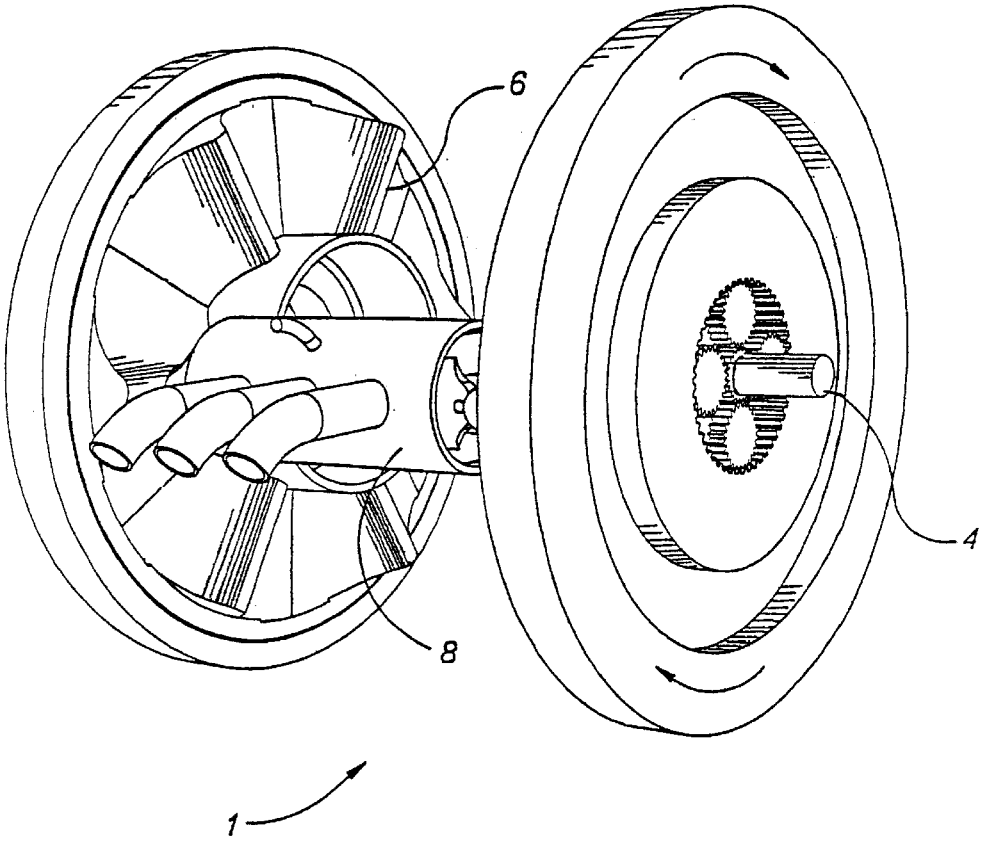
FIG. 3 is a pictorial view of the engine of FIGS. 1, 2, as seen from upper right.

The left flywheel 2 is connected to the output shaft 4 by a planetary gear system 3. The inner face of the flywheel 2 includes a cam surface 6. The right flywheel 5 is fixed to the output shaft 4, but is otherwise the same as the left flywheel 2. The cam surface 6 is of a wavy or rolling (e.g. sinusoidal) configuration, as best shown in FIG. 3.

In operation, the pistons 9 reciprocate in a cycle within the cylinder 8. FIG. 1 shows the pistons at the "top" of their compression strokes. When the pistons are at or near this "top" position, combustion in the cylinder 8 drives the pistons apart in power strokes to their "bottom" positions shown in FIG. 2. The cam rollers 7 push against their respective cam surfaces 6. The wavy cam surfaces 6, which are inclined relative to the axial thrust of the cam rollers 7, react to the cam rollers to rotate the flywheels 2, 5 and output shaft 4.

In the power/exhaust stroke, combustion gas is exhausted through exhaust ports 11. In the intake/compression stroke, air is forced into the cylinder through intake port 10 by positive charging means such as a compressor or supercharger (not shown).

During the intake/compression stroke, cam surfaces 6 drive the cam rollers 7 and pistons 9 inward. In other words, the cams 6 and rollers 7 are acting in the normal cam/follower relationship. During the power/exhaust stroke of the engine cycle, the relationship is inverted. The piston-driven cam rollers 7 act against the cam surfaces 6 to drive their respective flywheels. In spite of this inversion of functions during half of the engine cycle, it will nevertheless be convenient to consistently identify members 6 and 7 as "cam surface" and "cam roller" respectively.

The flywheels 2,5 rotate in opposite directions to give the engine 1 balance and smooth operation. One flywheel 5 is connected directly to the output shaft 4, while the other flywheel 2 is connected to the shaft 4 by a planetary gear system 3. Thus, while the flywheels turn in opposite directions, they act in the same direction on the output shaft.

There are several advantages to be realized from the engine 1 of this invention:

The engine 1 has no crankshaft or connecting rods, so the dynamic loads and stresses associated with such rapidly accelerating, decelerating, rotating, and reciprocating members are eliminated. Fewer rotating and reciprocating parts also reduces friction losses. The engine 1 is also lighter in weight because of fewer components, and because reduced internal antagonistic forces allow for lighter construction.

The cam surface configuration can be designed to vary or control certain parameters, including compression ratio, duration of the intake/exhaust stroke, duration of the combustion/power stroke, compression stroke pattern to maximize cylinder fill volumetric efficiency, and power stroke pattern to maximize transfer of power from piston to flywheel. In a conventional crankshaft-piston-connecting rod assembly, rotational duration is fixed by the radius of the crankshaft, and piston TDC and BTC duration can be only minimally altered by use of connecting rods of different lengths.

The expansible chamber itself can also be designed and configured to enhance certain characteristics. It reduces the weight of the reciprocating assemblies by eliminating connecting rods, crankshaft, and counterweights, and with fewer cylinders for a given number of power strokes per flywheel revolution. The tops of the two pistons form the combustion chamber at their top dead center, offering flexibility in designing the shape of the combustion chamber for complete and efficient combustion, flame propagation, and maximum combustion pressure. Improved combustion produces less pollution. Intake and exhaust ports can be located to enhance the discharge of exhaust gas, influx of incoming air, and tumbling and turbulence within the cylinder. Sparkplug and/or fuel injector can be positioned in relation to the combustion chamber for complete and efficient ignition and flame propagation. As compared to a conventional engine, the small space in the cylinder head and combustion chamber limits the positioning of intake and exhaust valves, spark plug, and/or fuel injector.

The drawing shows only one cylinder, as an example. Plural cylinders, and therefore plural power strokes can be added without addition of size. The number of power strokes per revolution is a function of the number of cylinders included, and also of the number of peaks and troughs on the cam surface.

The radially offset position of the cylinder relative to the output shaft can be altered to thereby alter the speed of revolution, torque, and horsepower output characteristics of the engine 1. A flatter torque curve can be achieved by moving the cylinder radially toward or away from the output shaft in relation to the rpm, thereby producing wider power range and requiring fewer gears in transmission.

Deviation of the angle of the cylinder axis in relation to the output shaft allows the outward push of the piston, during the power stroke, to exert more force on the cam surface and flywheel to produce more power at a given amount of combustion pressure in comparison to conventional engine design. An angle in the range of 20° to 30° might be optimal.

Power transmission from a power stroke exerting force on opposing flywheels rotating in opposite directions eliminates or reduces vibration, for a smooth running of the engine 1. The engine 1 can idle at lower rpm because less energy is required to rotate the flywheel and the reciprocating assemblies and less internal friction to overcome.

This engine 1 is more fuel efficient and produces less waste heat for a given amount of power output in comparison to conventional engines because less energy is required to rotate the flywheel and the reciprocating piston assemblies, and because more of the combustion pressure is applied to rotating the flywheels for power output. The simple drive train eliminates parasitic power losses from friction, opposing inertial from large reciprocating masses, camshaft, and valve train, thereby yielding more usable output power.

Finally, my engine 1 is compact because of the radial arrangement of plural cylinders around the output shaft.

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. An engine, including:

a rotatable flywheel having a flywheel axis and including an undulating cam surface;

an expansible chamber device including a piston having a central axis radially spaced from said flywheel axis, said piston abutting said cam surface and movable in a cycle between retracted and extended positions;

said cycle including a power stroke from said retracted position to said extended position to urge said piston against said cam surface to thereby rotate said flywheel, and a compression stroke from said extended position to said retracted position in response to said cam surface.

2. An engine, including:

a rotatable flywheel having a flywheel axis and including first and second undulating cam surfaces on opposite faces thereof;

a first expansible chamber device including a piston having a central axis radially spaced from said flywheel axis, said piston abutting said first cam surface and movable in a cycle between retracted and extended positions;

a second expansible chamber device including a piston having a central axis radially spaced from said flywheel axis, said piston abutting said second cam surface and movable in a cycle between retracted and extended positions;

said cycle including a power stroke from said retracted position to said extended position to urge said piston against said cam surface to thereby rotate said flywheel, and a compression stroke from said extended position to said retracted position in response to said cam surface.

3. An engine, including:

first and second coaxial and axially spaced flywheels operatively connected to a coaxial output shaft and including respectively first and second undulating cam surfaces facing each other; and an expansible chamber device disposed between said flywheels and radially offset relative to said output shaft, said expansible chamber device including first and second opposed pistons movable in a cylinder between retracted and extended positions, said pistons adapted for engagement with respectively said first and second cam surfaces;

said pistons operating in cycles including power strokes from said retracted positions to said extended positions to urge said pistons against respective cam surfaces to thereby rotate corresponding flywheels, and compression strokes from said extended positions to said retracted positions in response to said cam surfaces.

4. An engine as defined in claim 3, wherein one of said flywheels is directly connected to said output shaft for rotation therewith, and the other of said flywheels is operatively connected to said output shaft for rotation in the opposite direction of rotation.

5. An engine, including:

first and second coaxial and axially spaced flywheels operatively connected to a coaxial output shaft and respectively including first and second undulating cam surfaces facing each other; and an expansible chamber device disposed between said flywheels and radially offset relative to said output shaft, said expansible chamber device including a stationary cylinder with air inlet, fuel inlet, and exhaust ports, and first and second opposed pistons movable in said cylinder in opposite directions between retracted positions and extended positions, said pistons each including on the outboard end thereof a cam roller for engagement with a corresponding one of said cam surfaces;

said pistons operating in cycles including power strokes from said retracted positions to said extended positions, and compression strokes from said extended positions to said retracted positions;

said power strokes urging said cam rollers of said first and second pistons against respectively said first and second cam surfaces to thereby rotate said first and second flywheels;

said compression strokes responsive to action of said first and second cam surfaces against said cam rollers of respectively said first and second pistons to move said pistons to said retracted positions.

6. An engine as defined in claim 5, wherein one of said flywheels is directly connected to said output shaft for rotation therewith, and the other of said flywheels is operatively connected to said output shaft for rotation in the opposite direction of rotation.

7. An engine as defined in claim 1, wherein said cam surface is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

8. An engine as defined in claim 2, wherein at least one of said cam surfaces is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

9. An engine as defined in claim 3, wherein at least one of said cam surfaces is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

10. An engine as defined in claim 5, wherein at least one of said cam surfaces is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

11. An engine as defined in claim 1, wherein the expansible chamber device is radially moveable relative to said flywheel axis.

12. An engine as defined in claim 2, wherein an expansible chamber device is radially moveable relative to said flywheel axis.

13. An engine as defined in claim 3, wherein an expansible chamber device is radially moveable relative to the axis of said output shaft.

14. An engine as defined in claim 5, wherein an expansible chamber device is radially moveable relative to the axis of said output shaft.

15. An engine as defined in claim 1, wherein the central axis is angled with respect to said flywheel axis so as to cause the piston to exert more force on the cam surface during a power stroke.

16. An engine as defined in claim 2, wherein a central axis is angled with respect to said flywheel axis so as to cause a piston to exert more force on a cam surface during a power stroke.

17. An engine as defined in claim 3, wherein a central axis of an expansible chamber device is angled with respect to said flywheel axis so as to cause a piston to exert more force on a cam surface during a power stroke.

18. An engine as defined in claim 5, wherein a central axis of an expansible chamber device is angled with respect to said flywheel axis so as to cause a piston to exert more force on a cam surface during a power stroke.

* * * * *